US011542934B2

(12) United States Patent
Chen

(10) Patent No.: US 11,542,934 B2
(45) Date of Patent: Jan. 3, 2023

(54) DIAPHRAGM PUMP WITH HEAT DISSIPATION MECHANISM

(71) Applicant: Mighty Spraying Technology Co., Ltd, Taichung (TW)

(72) Inventor: Shou Jen Chen, Taichung (TW)

(73) Assignee: Mighty Spraying Technology Co., Ltd., Taichung (TW)

( * ) Notice: Subject to any disclaimer, the term of this patent is extended or adjusted under 35 U.S.C. 154(b) by 120 days.

(21) Appl. No.: 17/116,141

(22) Filed: Dec. 9, 2020

(65) Prior Publication Data

US 2022/0178374 A1 Jun. 9, 2022

(51) Int. Cl.

| | |
|---|---|
| ***F04B 43/02*** | (2006.01) |
| ***F04B 23/08*** | (2006.01) |
| ***F04B 53/08*** | (2006.01) |
| ***F04C 2/10*** | (2006.01) |

(52) U.S. Cl.

CPC ..... *F04B 43/02* (2013.01); *F04B 23/08* (2013.01); *F04B 53/08* (2013.01); *F04C 2/10* (2013.01); *F04C 2/102* (2013.01)

(58) Field of Classification Search

CPC ..... F04B 43/02; F04B 43/026; F04B 43/005; F04B 43/0045; F04B 43/067; F04B 23/08; F04B 53/08

See application file for complete search history.

(56) References Cited

U.S. PATENT DOCUMENTS

| | | | | |
|---|---|---|---|---|
| 4,403,924 A * | 9/1983 | Gebauer | ..... | F04B 43/067 417/388 |
| 5,145,331 A * | 9/1992 | Goes | ..... | F04B 43/067 417/63 |
| 2020/0088191 A1* | 3/2020 | Schaefer | ..... | F04C 2/102 |

* cited by examiner

*Primary Examiner* — Charles G Freay

(74) *Attorney, Agent, or Firm* — Alan D. Kamrath; Karin L. Williams; Mayer & Williams PC

(57) ABSTRACT

A diaphragm pump with a heat dissipation mechanism includes a seat body, a diaphragm assembly, and a rotor pump assembly. The seat body includes a rotating member therein. The diaphragm assembly includes a piston mechanism and a diaphragm mechanism. The diaphragm assembly and the seat body confine a first pump room in which a medium is received. The rotor pump assembly is disposed between the rotating member and the diaphragm assembly. The rotor pump assembly includes a casing. The casing includes a suction port communicated with the first pump room and a discharge port communicated with the at least one medium outlet. The rotor pump assembly includes an outer rotor rotatably connected with the casing and an inner rotor rotatably connected with the outer rotor. The inner rotor is rotatably connected with the drive shaft. The outer rotor and the inner rotor rotate at different speeds.

14 Claims, 8 Drawing Sheets

DIAPHRAGM PUMP WITH HEAT DISSIPATION MECHANISM

BACKGROUND OF THE INVENTION

1. Field of the Invention

The present invention relates to a diaphragm pump and, particularly, to a diaphragm pump with a heat dissipation mechanism.

2. Description of the Related Art

Diaphragm pumps are in commonly used various liquid delivery systems. Specifically, diaphragm pumps are used for delivering liquids, such as chemical raw materials, beverages and medicines. More specially, a plunger-type diaphragm pump, which uses the labor-saving design of a hydraulic plunger to push the diaphragm, can achieve energy-saving, clean and high-pressure transportation. The plunger-type diaphragm pump is driven by an electric motor to operate the hydraulic plunger to push the diaphragm. Such plunger-type diaphragm pump has a simple structure and is adapted to deliver liquids of various viscosities. Moreover, it saves energy and is not easily damaged even under idling.

Since the plunger-type diaphragm pump has a limited storage space for hydraulic oil, the system is liable to suffer excessive oil temperature easily and therefore the service life of parts are shortened.

The present invention is, therefore, intended to obviate or at least alleviate the problems encountered in the prior art.

SUMMARY OF THE INVENTION

According to the present invention, a diaphragm pump with a heat dissipation mechanism includes a seat body, a diaphragm assembly, a housing with inlet and outlet channels, a front cover, and a rotor pump assembly.

The seat body includes a rotatable drive shaft inserting therethrough and a rotating member therein connected with the drive shaft. The rotating member rotates upon rotation of the drive shaft.

The diaphragm assembly includes at least one piston mechanism connected with the rotating member and moving reciprocally upon rotation of the rotating member and at least one diaphragm mechanism connected with the at least one piston mechanism and moving reciprocally upon reciprocation of the at least one piston mechanism. The diaphragm assembly and the seat body are connected together and confine a first pump room in which a medium for the diaphragm assembly is received. The diaphragm assembly includes at least one medium outlet communicated with the first pump room.

The housing with inlet and outlet channels is communicated with a space in which the at least one diaphragm mechanism is disposed and includes a check valve disposed therein.

The front cover is connected with the housing with inlet and outlet channels. The front cover defines a second pump room in which a fluid to be delivered is to be received. The front cover includes an inlet and an outlet communicated with the second pump room. The fluid to be received is introduced in the second pump room through the inlet and forced thereout through the outlet in response to reciprocation of the at least one diaphragm mechanism.

The rotor pump assembly is disposed between the rotating member and the diaphragm assembly. The rotor pump assembly includes a casing connected with the diaphragm assembly. The casing includes a suction port communicated with the first pump room and a discharge port communicated with the at least one medium outlet. The rotor pump assembly includes an outer rotor rotatably connected with the casing and an inner rotor rotatably connected with the outer rotor. The inner rotor is rotatably connected with the drive shaft and rotates upon rotation of the drive shaft. The outer rotor rotates upon rotation of the inner rotor. The outer rotor and the inner rotor rotate at different speeds. The medium is introduced in the casing upon rotations of the outer and the inner rotors and forced out of the casing through the discharge port. Moreover, the medium is reintroduced in the casing after being forced out of the at least one medium outlet and gets cooled. The casing includes a casing cover connected therewith.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
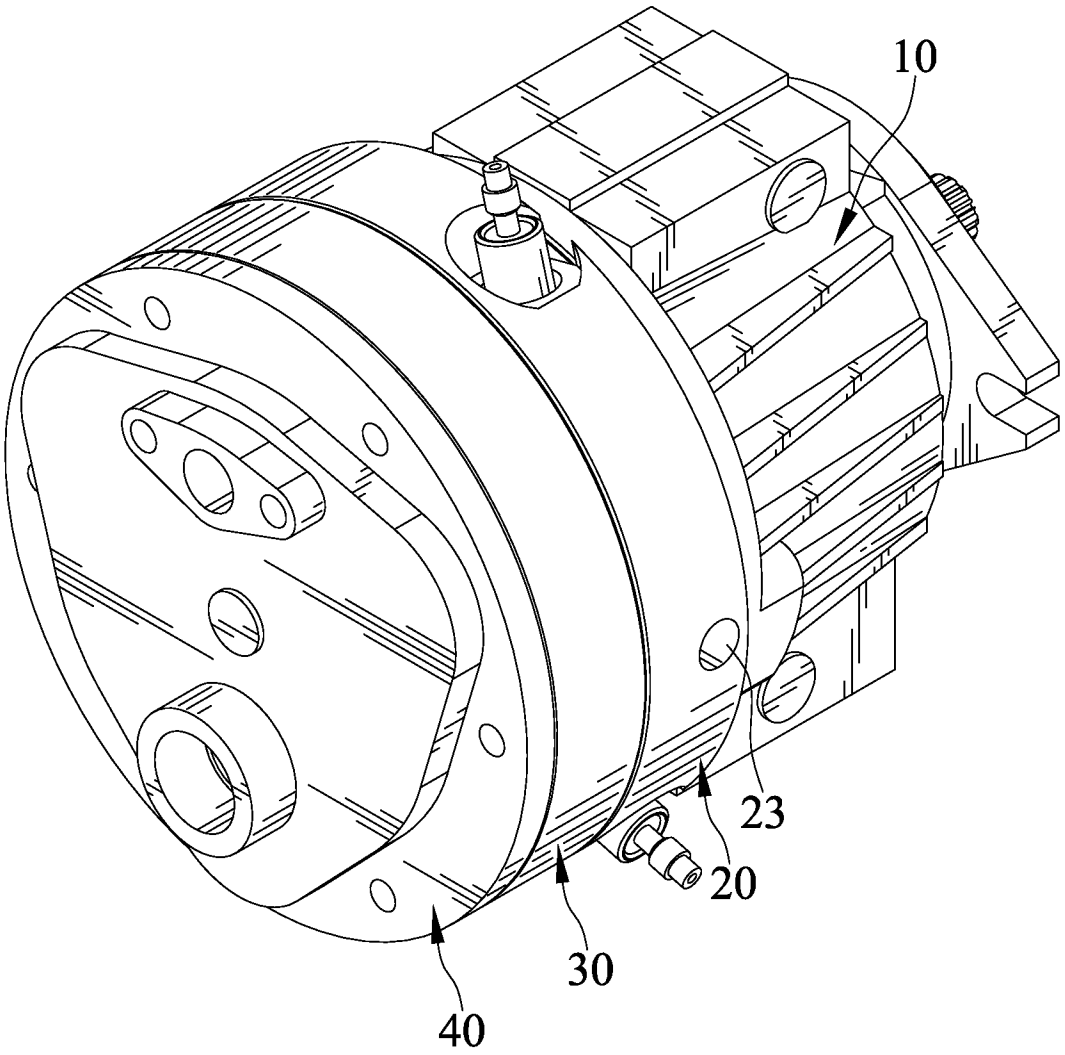
FIG. 1 is a perspective view of a diaphragm pump with a heat dissipation mechanism in accordance with a first embodiment of the present invention.
Figure 2:
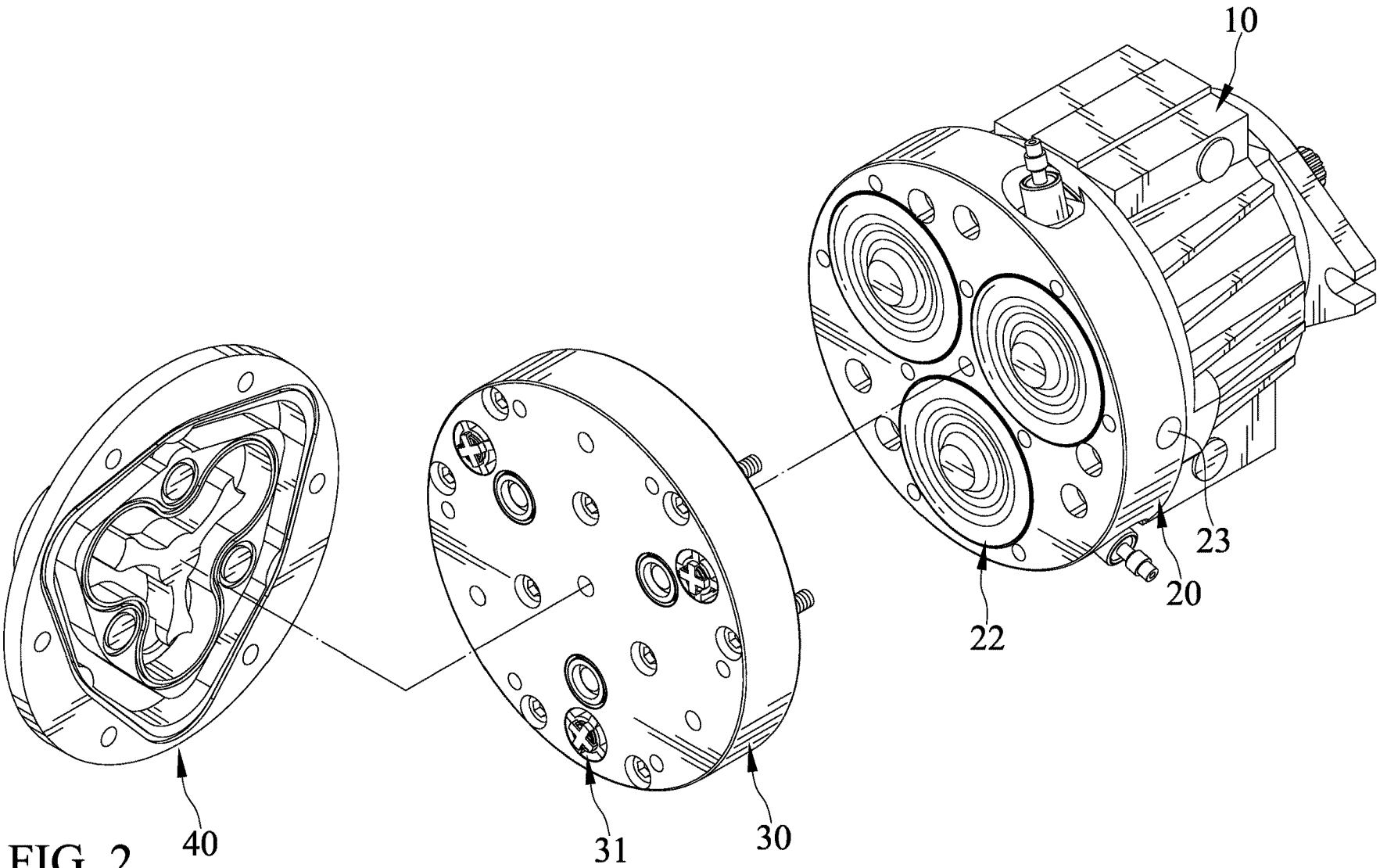
FIG. 2 is an exploded perspective views of the diaphragm pump of FIG. 1.
Figure 3:
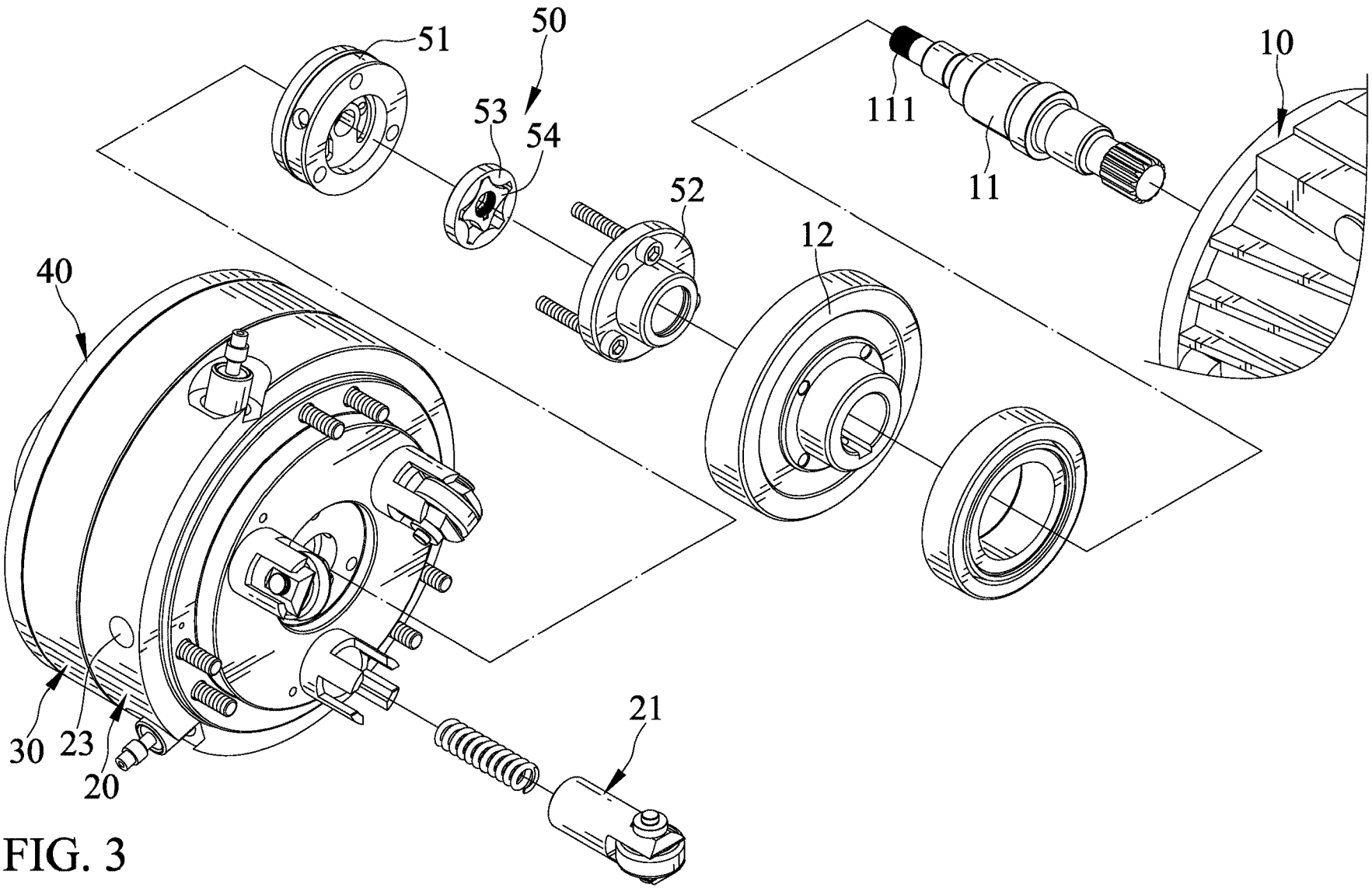
FIG. 3 is another exploded perspective views of the diaphragm pump of FIG. 1.
Figure 4:
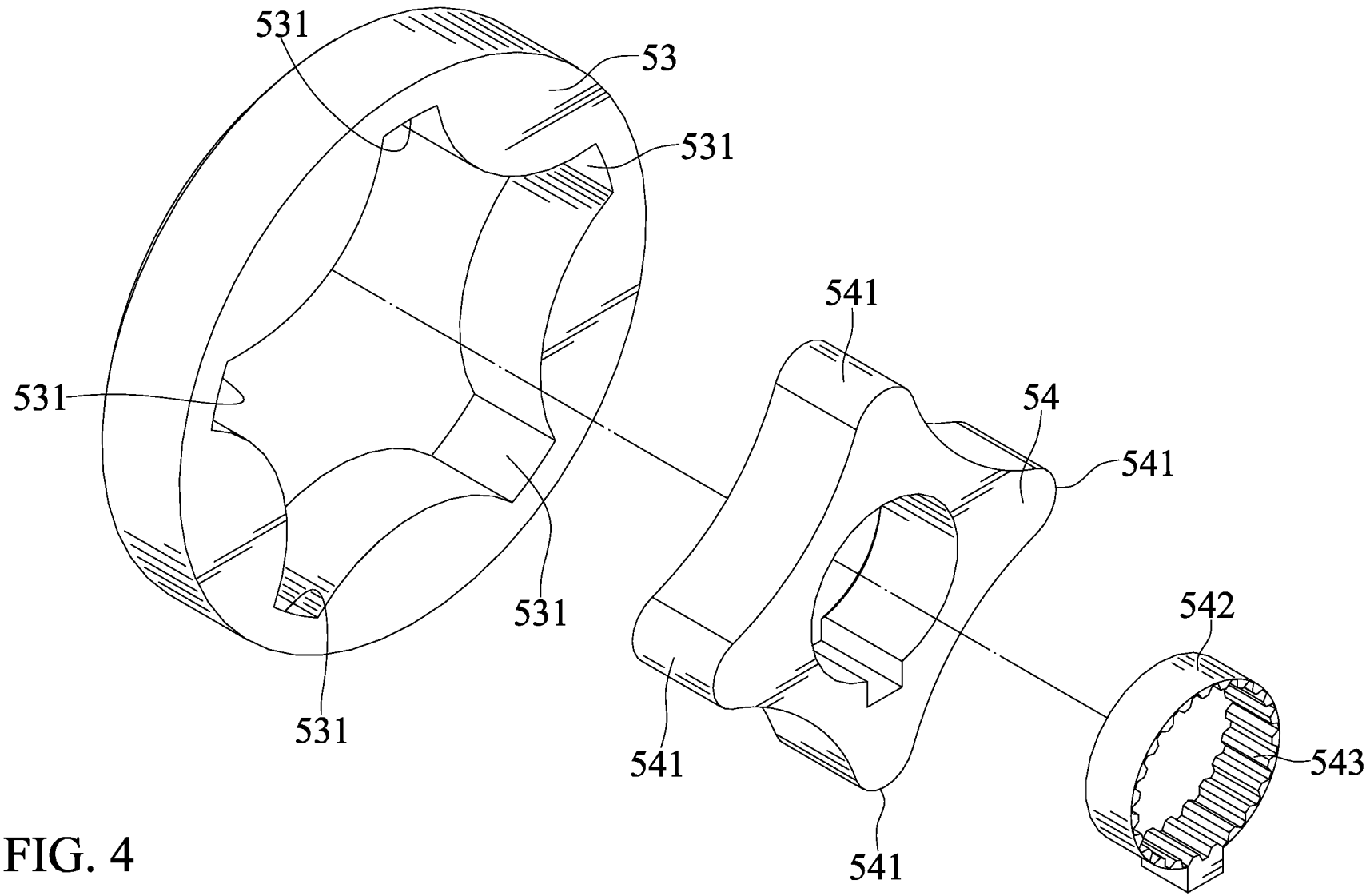
FIG. 4 is another exploded perspective view of the diaphragm pump of FIG. 1.
Figure 5:
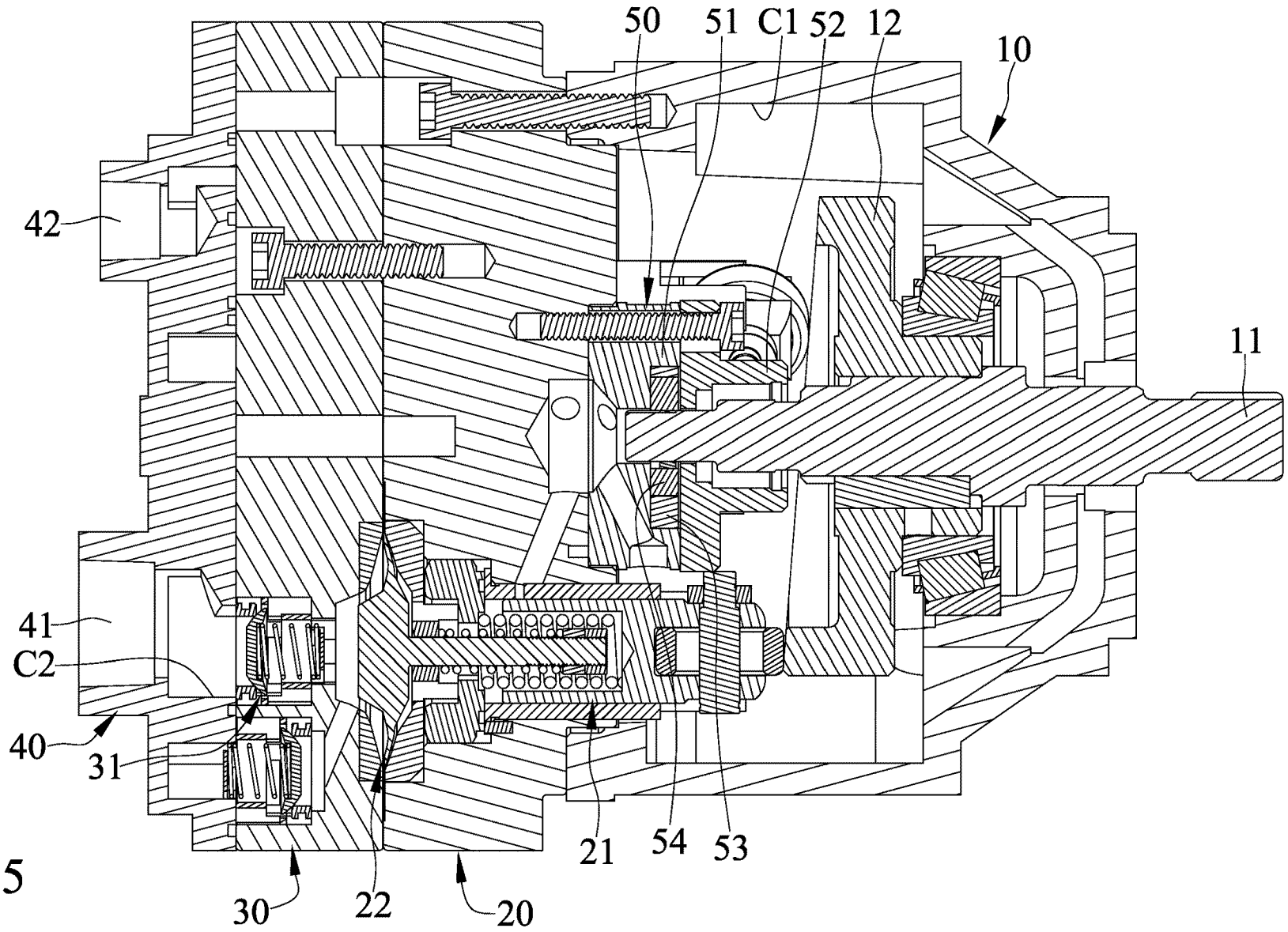
FIG. 5 is a cross-sectional view showing the diaphragm pump of FIG. 1 in a first working position.
Figure 6:
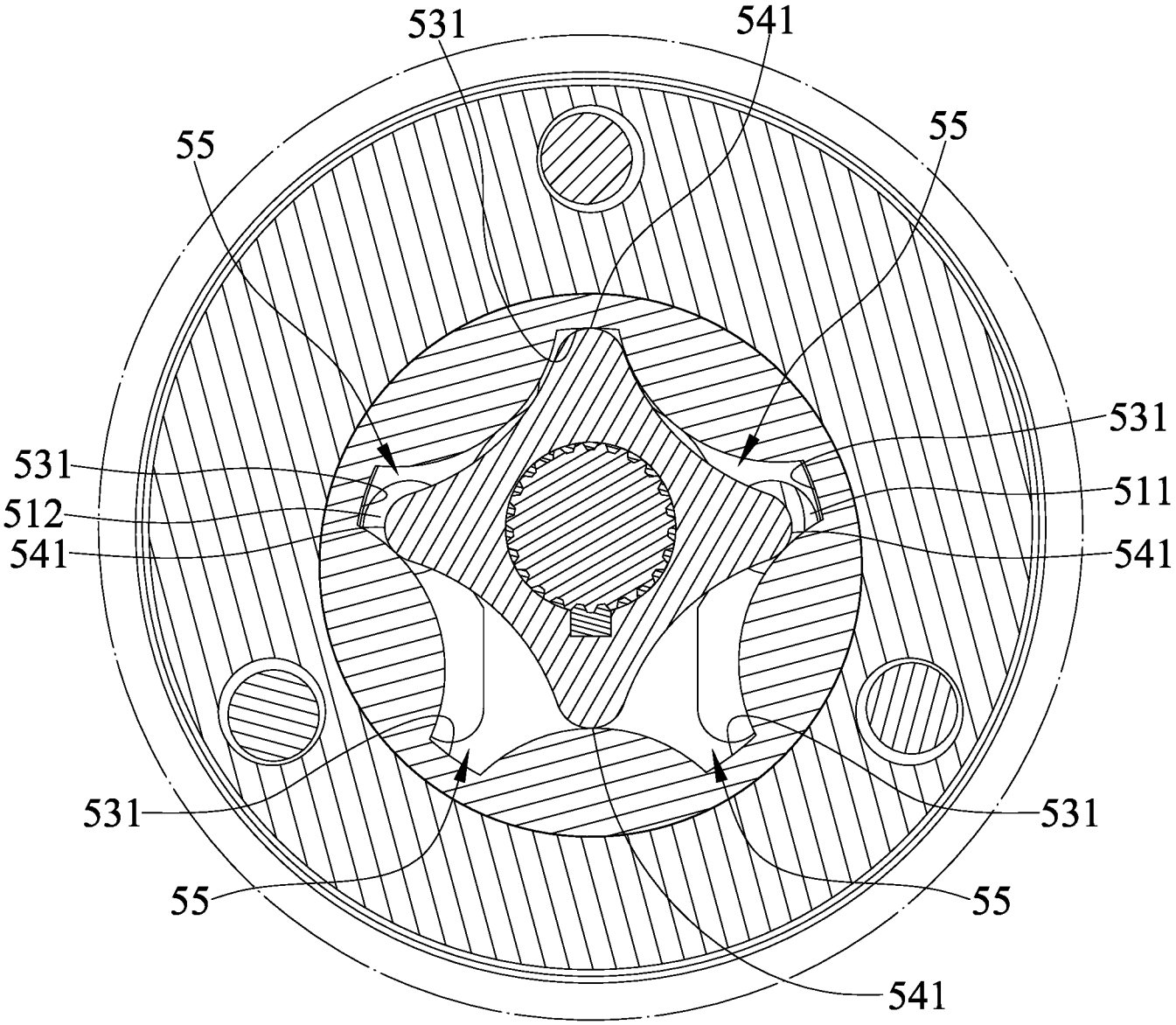
FIG. 6 is another cross-sectional view showing the diaphragm pump of FIG. 1 in the first working position.
Figure 7:
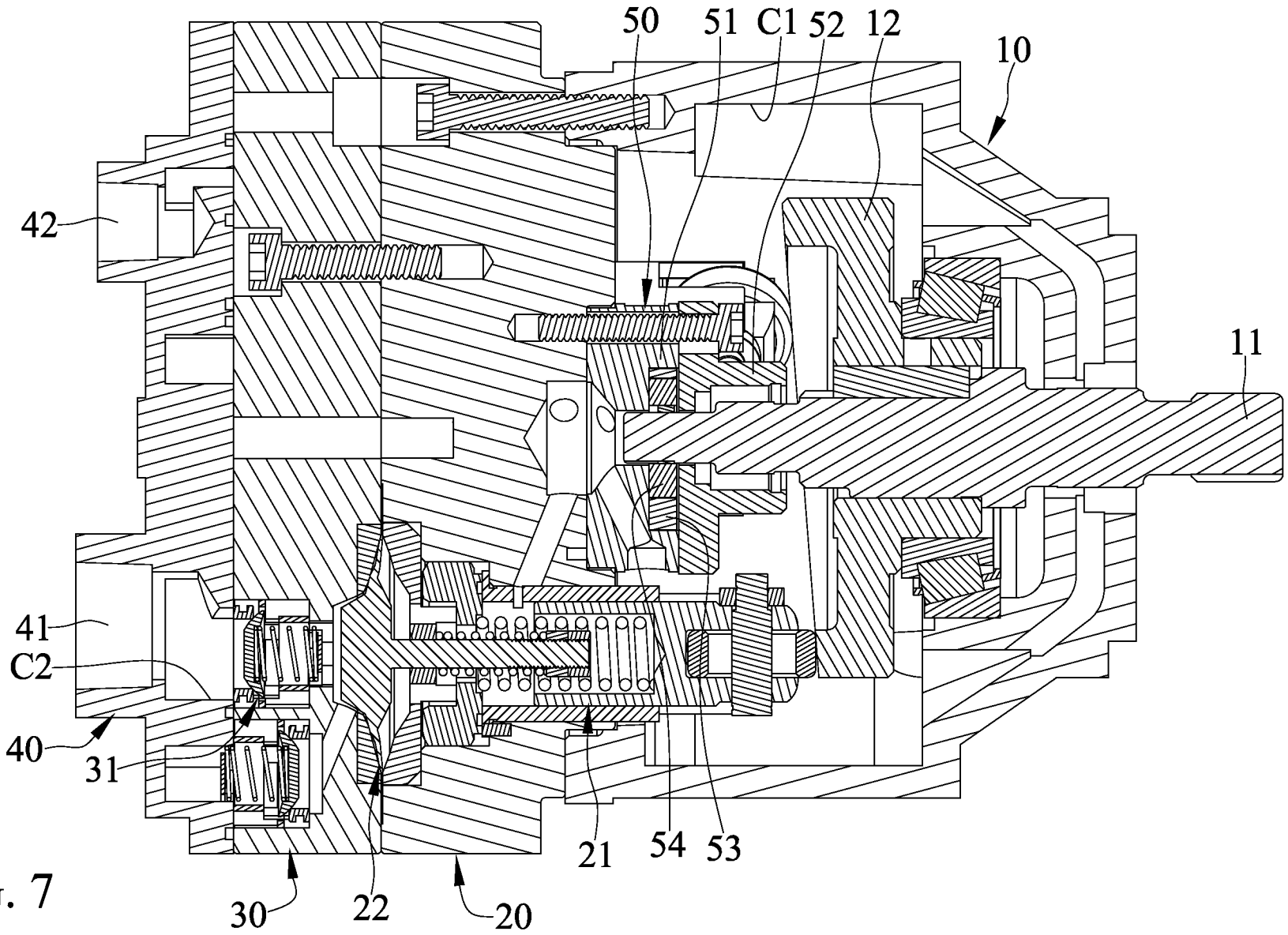
FIG. 7 is a cross-sectional view showing the diaphragm pump of FIG. 1 in a second working position.
Figure 8:
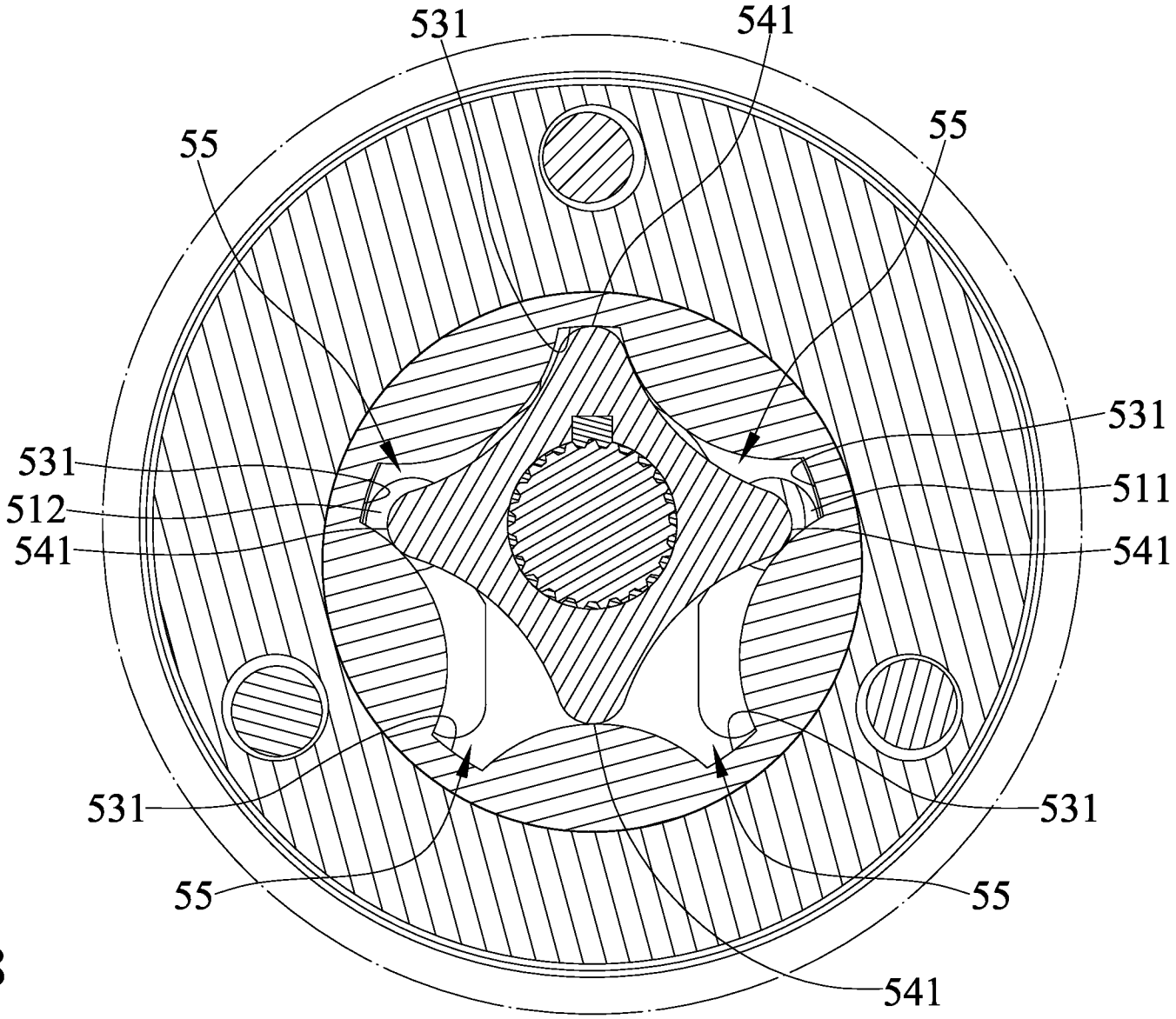
FIG. 8 is another cross-sectional view showing the diaphragm pump of FIG. 1 in the second working position.

FIGS. 1 through 8 show a diaphragm pump with a heat dissipation mechanism in accordance with the present invention including a seat body 10, a diaphragm assembly 20, a housing with inlet and outlet channels 30, a front cover 40, and a rotor pump assembly 50.

The seat body 10 includes a rotatable drive shaft 11 of a motor (not shown) inserting therethrough and a rotating member 12 therein connected with the drive shaft 11. The rotating member 12 rotates upon rotation of the drive shaft 11.

The diaphragm assembly 20 includes at least one piston mechanism 21 connected with the rotating member 12 and moving reciprocally upon rotation of the rotating member 12 and at least one diaphragm mechanism 22 connected with the at least one piston mechanism 21 and moving reciprocally upon reciprocation of the at least one piston mechanism 21. The diaphragm assembly 20 and the seat body 10 are connected together and confine a pump room C1 in which a medium for the diaphragm assembly 20 is received. The diaphragm assembly 20 includes at least one medium outlet 23 communicated with the pump room C1. The at least one medium outlet 23 extends radially and define an opening on a circumferential wall of a housing of the diaphragm assembly 20.

The housing with inlet and outlet channels 30 is communicated with a space in which the at least one diaphragm mechanism 22 is disposed and includes a check valve 31 disposed therein. The check valve 31 prevents the medium flowing from the outlet channel to the inlet channel.

The front cover 40 is connected with the housing with inlet and outlet channels 30. The front cover 40 defines a pump room C2 in which a fluid to be delivered is to be received. The front cover 40 includes an inlet port 41 and an outlet port 42 communicated with the pump room C2. The fluid to be received is introduced in the pump room C2 through the inlet port 41 and forced thereout through the outlet port 42 in response to reciprocation of the at least one diaphragm mechanism 22.

The rotor pump assembly 50 is disposed between the rotating member 12 and the diaphragm assembly 20. The rotor pump assembly 50 includes a casing 51 connected with the diaphragm assembly 20. The casing 51 includes a suction port 511 communicated with the pump room C1 and a discharge port 512 communicated with the at least one medium outlet 23. The rotor pump assembly 50 includes an outer rotor 53 rotatably connected with the casing 51 and an inner rotor 54 rotatably connected with the outer rotor 53. The inner rotor 54 is rotatably connected with the drive shaft 11 and rotates upon rotation of the drive shaft 11. The inner rotor 54 has an inner rotor bushing 542 and the drive shaft 11 is engaged with in the inner rotor bushing 542 such that the inner rotor 54 rotates upon rotation of the drive shaft 11. The drive shaft 11 has an engaging portion 111 and the inner rotor bushing 542 has an engaging portion 543 engaged with the engaging portion 111. Each of the engaging portions 111 and 543 forms a plurality of teeth. The outer rotor 53 rotates upon rotation of the inner rotor 54. The outer and the inner rotors 53 and 54 rotate at different speeds. The outer and the inner rotors 53 and 54 are rotatable about different axes which are deviated from one another with an eccentric distance.

The medium is introduced in the casing 51 upon rotations of the outer and the inner rotors 53 and 54 and forced out of the casing 51 through the discharge port 512. Further, the medium is reintroduced in the casing 51 after being forced out of the at least one medium outlet 23 and gets cooled.

The casing 51 includes a casing cover 52 connected therewith. The casing 51 is capped by the casing cover 52 and the outer and the inner rotors 53 and 54 are enclosed by the casing 51 and the casing cover 52. The casing cover 52 includes the drive shaft 11 inserting therethrough.

The outer rotor 53 has a plurality of engaging teeth 531 and the inner rotor 54 has a plurality of engaging teeth 541 engaging with the engaging teeth 531. The plurality of first and second engaging teeth 531 and 541 have trochoid geometries. The outer rotor 53 defines a plurality of working chambers 55 in which the plurality of engaging teeth 541 is disposed. Each of the plurality of working chambers 55 is selectively communicated with the suction port 511 and the discharge port 512. Each of the plurality of working chambers' 55 volume varies in response to changes between a first position in which the outer and the inner rotors 53 and 54 are in a first relative position in which each of the plurality of working chambers 55 is communicated with the suction port 511 and a second position in which the outer and the inner rotors 53 and 54 are in a second relative position in which each of the plurality of working chambers 55 is communicated with the discharge port 512. Each of the plurality of engaging teeth 531 is in a form of a recess and each of the plurality of second engaging teeth 541 is in a form of a protrusion, respectively. The number of the plurality of engaging teeth 531 is n and the number of the plurality of engaging teeth 541 is n−1, In the embodiment, n equals 5.

In view of the foregoing, the diaphragm pump includes the rotor pump assembly 50 adapted to dissipate heat. Specifically, the medium is introduced in the casing 51 upon rotations of the outer and the inner rotors 53 and 54 and forced thereout through the discharge port 512. Further, the medium is reintroduced in the casing 51 after being forced out of the at least one medium outlet 23 and get cooled The foregoing is merely illustrative of the principles of this invention and various modifications can be made by those skilled in the art without departing from the scope and spirit of the invention.

What is claimed is:

1. A diaphragm pump with a heat dissipation mechanism comprising:

a seat body including a rotatable drive shaft inserting therethrough and a rotating member therein connected with the drive shaft, wherein the rotating member rotates upon rotation of the drive shaft;

a diaphragm assembly including at least one piston mechanism connected with the rotating member and moving reciprocally upon rotation of the rotating member and at least one diaphragm mechanism connected with the at least one piston mechanism and moving reciprocally upon reciprocation of the at least one piston mechanism, wherein the diaphragm assembly and the seat body are connected together and define a first pump room in which a medium for the diaphragm assembly is received, and wherein the diaphragm assembly includes at least one medium outlet communicated with the first pump room;

a housing with inlet and outlet channels communicated with a space in which the at least one diaphragm mechanism is disposed and wherein the housing includes a check valve disposed therein;

a front cover connected with the housing, the front cover including inlet and outlet channels and defining a second pump room in which a fluid to be delivered is to be received, and including an inlet port and an outlet port communicated with the second pump room, wherein the fluid to be received is introduced in the second pump room through the inlet port and forced thereout through the outlet port in response to reciprocation of the at least one diaphragm mechanism; and a rotor pump assembly disposed between the rotating member and the diaphragm assembly and including a casing connected with the diaphragm assembly, wherein the casing includes a suction port communicated with the first pump room and a discharge port communicated with the at least one medium outlet, wherein the rotor pump assembly includes an outer rotor rotatably connected with the casing and an inner rotor rotatably connected with the outer rotor, wherein the inner rotor is rotatably connected with the drive shaft and rotates upon rotation of the drive shaft, wherein the outer rotor rotates upon rotation of the inner rotor, wherein the outer rotor and the inner rotor rotate at different speeds, wherein the medium is introduced in the casing upon rotations of the outer and the inner rotors and forced out of the casing through the discharge port, wherein the medium is reintroduced in the casing after being forced out of the at least one medium outlet and being cooled, and wherein the casing includes a casing cover connected therewith.

2. The diaphragm pump as claimed in claim 1, wherein the casing is capped by the casing cover and the outer and the inner rotors are enclosed by the casing and the casing cover.

3. The diaphragm pump as claimed in claim 2, wherein the casing cover includes a hole through which the drive shaft extends.

4. The diaphragm pump as claimed in claim 1, wherein the outer and the inner rotors are rotatable about different axes which are displaced from one another with an eccentric distance.

5. The diaphragm pump as claimed in claim 4, wherein the outer rotor has a plurality of first engaging teeth and the inner rotor has a plurality of second engaging teeth engaging with the first engaging teeth, wherein the outer rotor defines a plurality of working chambers in which the plurality of second engaging teeth is disposed, wherein each of the plurality of working chambers is selectively communicated with the suction port and the discharge port, and wherein each of the plurality of working chambers' volume varies in response to changes between a first position in which the outer and the inner rotors are in a first relative position in which each of the plurality of working chambers is communicated with the suction port and a second position in which the outer and the inner rotors are in a second relative position in which each of the plurality of working chambers is communicated with the discharge port.

6. The diaphragm pump as claimed in claim 5, wherein each of the plurality of first engaging teeth is in a form of a recess and each of the plurality of second engaging teeth is in a form of a protrusion respectively, and wherein the number of the plurality of first engaging teeth is n and the number of the plurality of second engaging teeth is n−1.

7. The diaphragm pump as claimed in claim 6, wherein n equals 5.

8. The diaphragm pump as claimed in claim 5, wherein the plurality of first and second engaging teeth have trochoid geometries.

9. The diaphragm pump as claimed in claim 8, wherein each of the plurality of first engaging teeth is in a form of a recess and each of the plurality of second engaging teeth is in a form of a protrusion, and wherein the number of the plurality of first engaging teeth is n and the number of the plurality of second engaging teeth is n−1.

10. The diaphragm pump as claimed in claim 1, wherein the inner rotor has an inner rotor bushing and the drive shaft is engaged with the inner rotor bushing such that the inner rotor rotates upon rotation of the drive shaft.

11. The diaphragm pump as claimed in claim 5, wherein the casing is capped by the casing cover and the outer and the inner rotors are enclosed by the casing and the casing cover.

12. The diaphragm pump as claimed in claim 11, wherein the casing cover includes a hole through which the drive shaft extends.

13. The diaphragm pump as claimed in claim 12, wherein the plurality of first and second engaging teeth have trochoid geometries.

14. The diaphragm pump as claimed in claim 13, wherein the inner rotor has an inner rotor bushing and the drive shaft is engaged with the inner rotor bushing such that the inner rotor rotates upon rotation of the drive shaft.

* * * * *